US012473907B1

(12) United States Patent
Redfearn

(10) Patent No.: US 12,473,907 B1
(45) Date of Patent: Nov. 18, 2025

(54) DOUBLE-ACTING DOWNHOLE HYDRAULIC RECIPROCATING PUMP SYSTEM AND METHODS OF USING SAME

(71) Applicant: James R. Redfearn, Tulsa, OK (US)

(72) Inventor: James R. Redfearn, Tulsa, OK (US)

( * ) Notice: Subject to any disclaimer, the term of this patent is extended or adjusted under 35 U.S.C. 154(b) by 0 days.

(21) Appl. No.: 19/085,723

(22) Filed: Mar. 20, 2025

(51) Int. Cl.

| | |
|---|---|
| ***F04B 23/06*** | (2006.01) |
| ***E21B 43/12*** | (2006.01) |
| ***F04B 9/111*** | (2006.01) |
| ***F04B 19/22*** | (2006.01) |
| ***F04B 47/02*** | (2006.01) |
| ***F04B 47/04*** | (2006.01) |
| *F04B 17/03* | (2006.01) |

(52) U.S. Cl.
CPC ..... *F04B 47/02* (2013.01); *E21B 43/126* (2013.01); *F04B 19/22* (2013.01); *F04B 17/03* (2013.01)

(58) Field of Classification Search
CPC ..... F04B 19/22; F04B 23/06; F04B 47/04; F04B 9/111; F04B 9/113; E21B 43/129
See application file for complete search history.

(56) References Cited

U.S. PATENT DOCUMENTS

| | | | | |
|---|---|---|---|---|
| 3,922,116 | A | 11/1975 | Pugh | |
| 4,347,049 | A * | 8/1982 | Anderson | F04B 47/04 417/403 |
| 4,762,473 | A * | 8/1988 | Tieben | E21B 43/126 417/399 |
| 7,708,058 | B1 | 5/2010 | Gipson | |
| 8,366,413 | B2 * | 2/2013 | Corbeil | E21B 43/129 417/390 |
| 8,449,265 | B2 * | 5/2013 | Marica | F04B 15/02 417/215 |
| 10,024,122 | B2 | 7/2018 | Bujold et al. | |
| 10,544,662 | B2 * | 1/2020 | Ding | E21B 43/2406 |
| 10,788,029 | B2 * | 9/2020 | Scott | F04B 47/12 |
| 12,098,712 | B2 * | 9/2024 | Cook | F04B 23/02 |
| 2020/0248680 | A1 | 8/2020 | Lu et al. | |
| 2022/0243708 | A1 * | 8/2022 | Bridges | F04B 9/113 |

* cited by examiner

*Primary Examiner* — Kenneth L Thompson

(57) ABSTRACT

A method of pumping produced liquids from the depths of a wellbore during a reset stroke and a power stroke of a pump located downhole, wherein the pump comprises an upper barrel, a lower barrel, an upper plunger within the upper barrel, a lower plunger within the lower barrel, an upper ported intake sub with an upper outlet check valve and an upper intake check valve, a dual ported mandrel, and a lower ported intake sub with a lower intake check valve and a lower outlet check valve.

4 Claims, 8 Drawing Sheets

Double-Acting Downhole Hydraulic Reciprocating Pump Detail

Double-Acting Downhole Hydraulic Reciprocating Pump Detail

DOUBLE-ACTING DOWNHOLE HYDRAULIC RECIPROCATING PUMP SYSTEM AND METHODS OF USING SAME

BACKGROUND

1. Field of Inventions

The field of this application and any resulting patent is double-acting downhole hydraulic reciprocating pump systems and methods of using same.

2. Description of Related Art

Various methods and systems have been proposed and utilized for using downhole pumps, including some of the methods and systems disclosed in the references appearing on the face of this patent. However, those methods and systems lack all the steps or features of the methods and systems covered by any patent claims below. As will be apparent to a person of ordinary skill in the art, any methods and systems covered by claims of the issued patent solve many of the problems that prior art methods and systems have failed to solve. Also, the methods and systems covered by at least some of the claims of this patent have benefits that could be surprising and unexpected to a person of ordinary skill in the art based on the prior art existing at the time of invention.

SUMMARY

One or more specific embodiments disclosed herein includes a method of pumping produced liquids in a downhole wellbore during a reset stroke of a downhole pump, comprising providing surface equipment comprising a first three-way valve; a positive displacement pump (PDP); a second three-way valve; and a power fluid reservoir, wherein the power fluid reservoir contains power fluid; providing a downhole pump comprising an upper barrel; a lower barrel; an upper plunger, wherein the upper plunger is positioned within the upper barrel; a lower plunger, wherein the lower plunger is positioned within the lower barrel; an upper ported intake sub, wherein the upper ported intake sub comprises an upper outlet check valve and an upper intake check valve; a dual ported mandrel; and a lower ported intake sub, wherein the lower ported intake sub comprises a lower intake check valve and a lower outlet check valve; providing a restroke control line, a power control line, and a produced liquids tube; actuating and aligning the first three-way valve, wherein a first flow path is created between the PDP and the restroke control line; actuating and aligning the second three-way valve, wherein a second flow path is created between the power control line and the power fluid reservoir; and pumping the power fluid into the restroke control line, wherein the upper plunger is forced to move toward the surface within the upper barrel, wherein produced liquids in the upper barrel between the upper plunger and the upper ported intake sub are compressed and forced to exit the upper ported intake sub through the upper outlet check valve and into the produced liquids tube, and further wherein the lower plunger is forced to move toward the surface within the lower barrel, wherein power fluid in the lower barrel between the lower plunger and the dual ported mandrel is compressed and returned to the power fluid reservoir through the power control line; wherein during the step of pumping power fluid into the restroke power line, the portion of the lower barrel between the lower plunger and the lower ported intake sub is filled with produced liquids through the lower intake check valve.

DETAILED DESCRIPTION

1. Introduction

Figure 1:
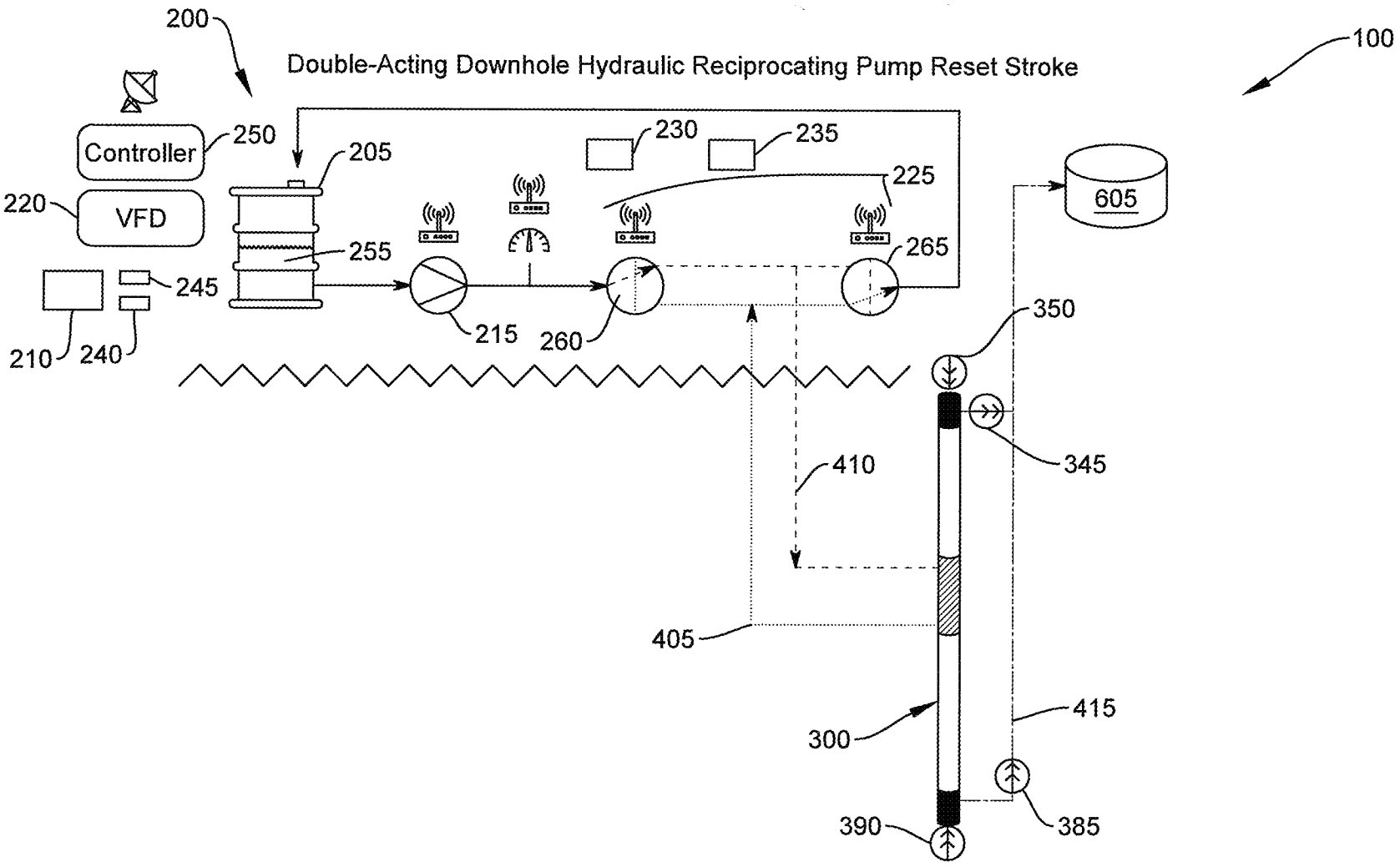
FIG. 1 is an illustration of an embodiment of a double-acting downhole hydraulic reciprocating pump system during a reset stroke.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in any printed publication, dictionary, or issued patent.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein includes a method of pumping produced liquids in a downhole wellbore during a reset stroke of a pump, comprising providing surface equipment comprising a first three-way valve; a positive displacement pump (PDP); a second three-way valve; and a power fluid reservoir, wherein the power fluid reservoir contains power fluid; providing a pump comprising an upper barrel; a lower barrel; an upper plunger, wherein the upper plunger is positioned within the upper barrel; a lower plunger, wherein the lower plunger is positioned within the lower barrel; an upper ported intake sub, wherein the upper ported intake sub comprises an upper outlet check valve and an upper intake check valve; a dual ported mandrel; and a lower ported intake sub, wherein the lower ported intake sub comprises a lower intake check valve and a lower outlet check valve; providing a restroke control line, a power control line, and a produced liquids tube; actuating and aligning the first three-way valve, wherein a first flow path is created between the PDP and the restroke control line; actuating and aligning the second three-way valve, wherein a second flow path is created between the power control line and the power fluid reservoir; and pumping the power fluid into the restroke control line, wherein the upper plunger is forced to move toward the surface within the upper barrel, wherein produced liquids in the upper barrel between the upper plunger and the upper ported intake sub are compressed and forced to exit the upper ported intake sub through the upper outlet check valve and into the produced liquids tube, and further wherein the lower plunger is forced to move toward the surface within the lower barrel, wherein power fluid in the lower barrel between the lower plunger and the dual ported mandrel is compressed and returned to the power fluid reservoir through the power control line; wherein during the step of pumping power fluid into the restroke power line, the portion of the lower barrel between the lower plunger and the lower ported intake sub is filled with produced liquids through the lower intake check valve.

In any one of the methods or systems disclosed herein, the method may comprise pumping of produced liquids in the downhole wellbore during a power stroke of the pump, comprising actuating and aligning the first three-way valve, wherein a third flow path is created between the PDP and the power control line; actuating and aligning the second three-way valve, wherein a fourth flow path is created between the restroke control line and the power fluid reservoir; and pumping the power fluid into the power control line, wherein the upper plunger is forced to move downhole within the upper barrel, wherein the power fluid in the upper barrel between the upper plunger and the dual ported mandrel is compressed and returned to the power fluid reservoir through the restroke control line, and further wherein the lower plunger is forced to move downhole within the lower barrel, wherein the produced liquids in the lower barrel between the lower plunger and the lower ported intake sub are compressed and forced to exit the lower outlet check valve into the produced liquids tube; wherein during the step of pumping the power fluid into the power control line, the portion of the upper barrel between the upper plunger and the upper ported intake sub is filled with produced liquids through the upper intake check valve.

In any one of the processes or systems disclosed herein, the steps of actuating and aligning the first three-way valve and the second three-way valve may occur simultaneously.

4. Specific Embodiments in the Figures

The drawings presented herein are for illustrative purposes only and are not intended to limit the scope of the claims. Rather, the drawings are intended to help enable one having ordinary skill in the art to make and use the claimed inventions.

Figure 2:
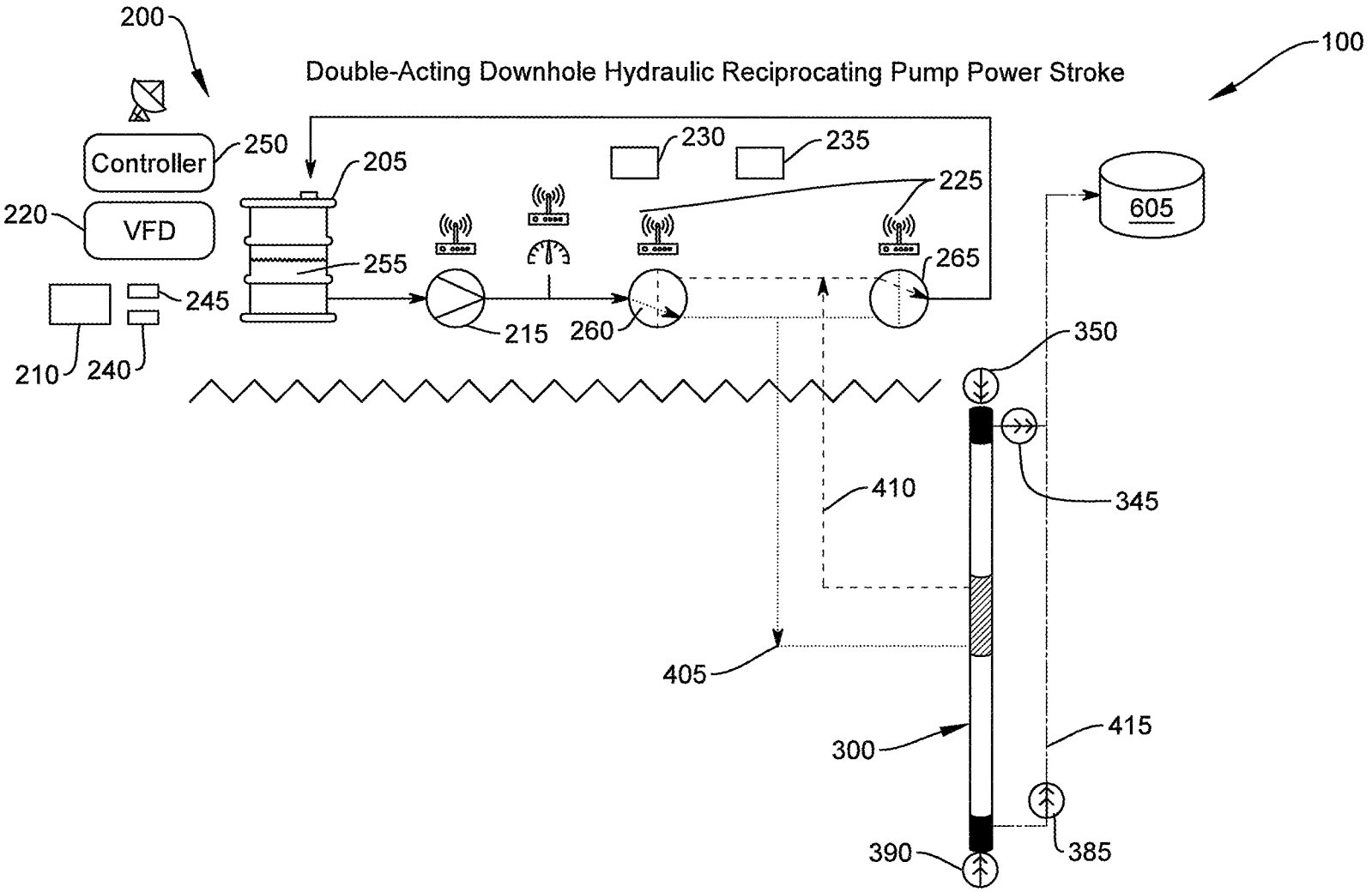
FIG. 2 is an illustration of an embodiment of a double-acting downhole hydraulic reciprocating pump system during a power stroke.

FIGS. 1 and 2 illustrate an embodiment of a double-acting downhole hydraulic reciprocating pump system 100. In embodiments, the pump system 100 may comprise surface control equipment 200, a downhole hydraulic reciprocating downhole pump 300, piping 400, and a trailer 500. Additionally, the pump system 100 may be employed in relation to one or more wellbores 600 in order to pump produced liquids 605. In embodiments, the produced liquids 605 may comprise reservoir oil and water.

In embodiments, the surface control equipment 200 may comprise a power fluid reservoir 205, an electric motor 210, a positive displacement pump ("PDP") 215, a variable frequency drive ("VFD") 220, a first three-way valve 260, a second three-way valve 265, one or more pressure sensors 230, one or more pressure switches 235, one or more level switches 240, one or more power sensors 245, and a programmable logic controller 250. Further, in certain embodiments, the equipment 200 may further comprise a manifold 225, wherein the manifold 225 may comprise the first three-way valve 260 and the second three-way valve 265. In embodiments, various sensors, telemetry, and/or other monitoring/controlling devices may be employed.

In embodiments, the power fluid reservoir 205 may contain power fluid 255. Further, the PDP 215 may be controlled by the electric motor 210. In embodiments, the VFD 220 may control the electric motor 210 and, thus, the PDP 215, which may allow the VFD 220 to control the speed of the PDP 215. Further, the VFD 220 may allow for precise adjustment and control of the speed and acceleration of the electric motor 210, and therefore, the resulting flow rate of the power fluid 255, the pressure within a restroke control line 410 and a power control line 405, the velocity of an upper plunger 392 and a lower plunger 394, the cycle time of the reset and power strokes, and ultimately the flow rate of produced liquids 605 to the surface.

In embodiments, the first three-way valve 260 and the second three-way valve 265 may each be electrically-actuated as well as direct and reverse flow of the power fluid 255. In embodiments, the one or more level switches 240 may be capable of stopping the pump system 100 if the power fluid 255 becomes depleted. In alternative embodiments, the one or more level switches 240 may be one or more level sensors instead. In embodiments, the controller 250 may receive feedback from the one or more pressure sensors 230, the one or more power sensors 245, and potentially other sensors. Further, the controller 250 may issue commands to the VFD 220 as well as to the first three-way valve 260 and the second three-way valve 265.

Figure 3A:
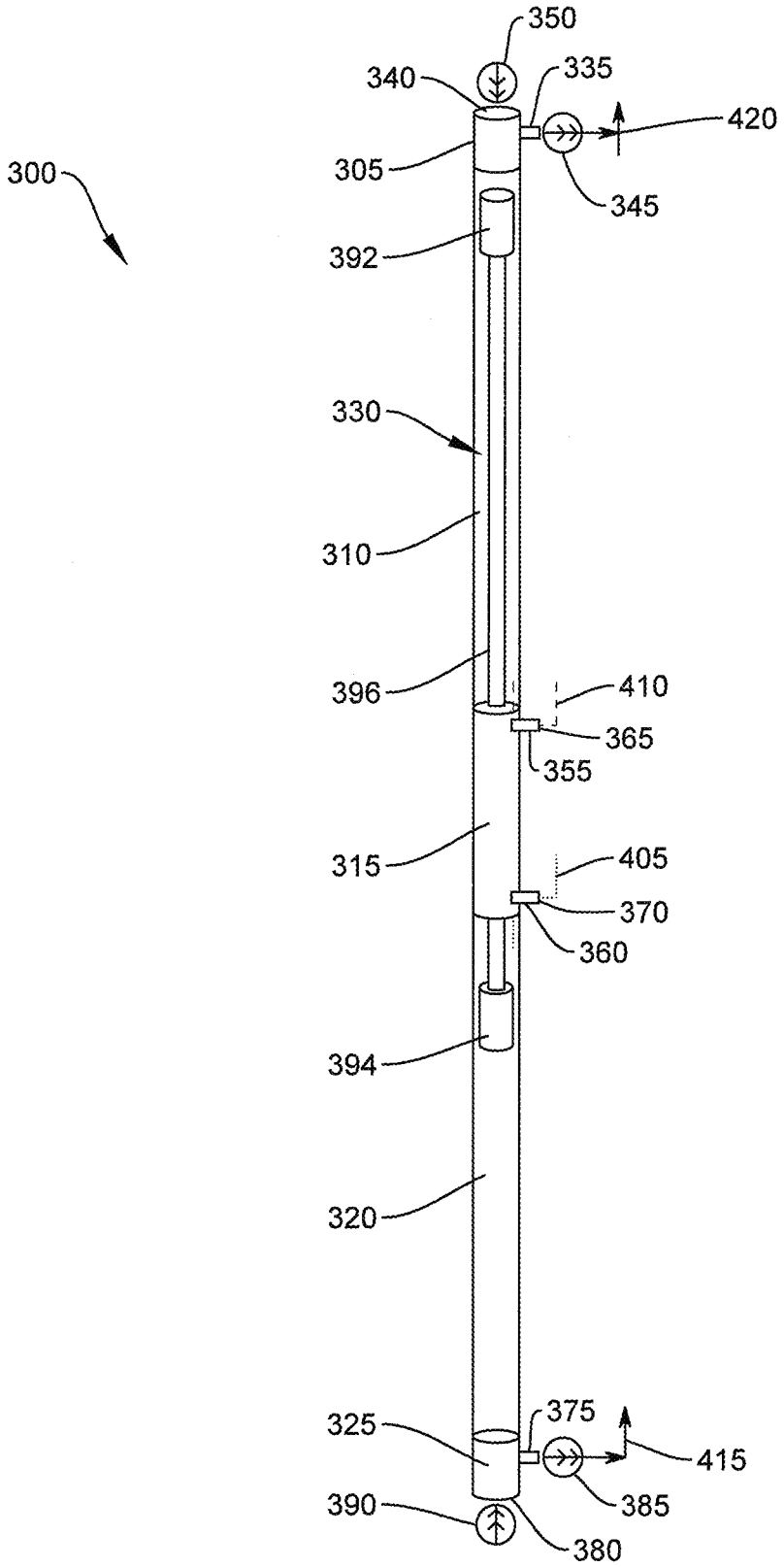
FIG. 3A is an illustration of an embodiment of a double-acting downhole hydraulic reciprocating pump.

FIG. 3A illustrates an embodiment of the downhole pump 300. In embodiments, the downhole pump 300 may comprise an upper ported intake sub 305, an upper barrel 310, a dual ported mandrel 315, a lower barrel 320, a lower ported intake sub 325, and a plunger 330.

In embodiments, the upper ported intake sub 305 may comprise an upper side outlet 335 and an upper intake 340. The upper side outlet 335 may comprise an upper outlet check valve 345, and the upper intake 340 may comprise an upper intake check valve 350. Further, the dual ported mandrel 315 may comprise an upper port 355 and a lower port 360. The upper port 335 may comprise an upper port fitting 365, and the lower port 360 may comprise a lower port fitting 370.

In embodiments, the lower barrel 320 may comprise an equal length and size as the upper barrel 310. Further, the dual ported mandrel 315 may comprise a significantly smaller inside diameter compared to the inside diameter of the upper barrel 310 and the lower barrel 320.

In embodiments, the lower ported intake sub 325 may comprise a lower side outlet 375 and a lower intake 380. The lower side outlet 375 may comprise a lower outlet check valve 385, and the lower intake 380 may comprise a lower intake check valve 390. The lower outlet check valve 385 may allow for a flow orientation opposite to that of the lower intake check valve 390. Further, the lower ported intake sub 325 may be attached to the bottom of the lower barrel 320.

In embodiments, the plunger 330 may comprise the upper plunger 392, the lower plunger 394, and a connecting rod 396. The lower plunger 394 may travel in unison with the upper plunger 392. The connecting rod 396 connects the upper plunger 392 to the lower plunger 394. Further, the connecting rod 396 may pass through the inside diameter of the dual ported mandrel 315.

In embodiments, the upper outlet check valve 345 may allow produced liquids 605 to exit the upper barrel 310 into a produced liquids tube 415 when the upper plunger 392 moves upward toward the surface. The upper intake check valve 350 may allow produced liquids 605 to enter the upper barrel 310 when the upper plunger 392 moves downward or downhole. Additionally, the lower outlet check valve 385 may allow produced liquids to exit the lower ported intake sub 325 as the lower plunger 394 moves downward or downhole. The lower intake check valve 390 may allow produced liquids 605 from the wellbore 605 to enter the lower barrel 320 as the lower plunger 394 moves upward toward the surface.

In embodiments, the upper barrel 310, the lower barrel 320, the upper plunger 392, the lower plunger 394, the connecting rod 396, and the dual ported mandrel 315 may each be machined to fine tolerances such that a metal-to-metal seal may form between the respective surfaces as described above. In an alternative embodiment, one or more seal grooves 397 may be machined into specific surfaces for the use of one or more sealing elements 398 within the downhole pump 300. The one or more seal grooves 397 and the one or more sealing elements 398 may be employed on the upper barrel 310, the lower barrel 320, the upper plunger 392, the lower plunger 394, the connecting rod 396, and the dual ported mandrel 315.

In embodiments, the piping 400 may comprise the power control line 405, the restroke control line 410, and the produced liquids tube 415. The power control line 405 may connect the power fluid reservoir 205 to the lower port 360. Further, the power control line 405 may allow the power fluid 255 to flow from the power fluid reservoir 205 to the downhole pump 300 through employment of the electric motor 210 and the PDP 215. The restroke control line 410 may connect the power fluid reservoir 205 to the upper port 355. Further, the restroke control line 410 may receive return flow of the power fluid 255, of an equal rate and volume as the power control line 405, as the power fluid 255 flows from the downhole pump 300 to the power fluid reservoir 205. The produced liquids tubing 415 may connect to the lower side outlet 375. Further, the produced liquids tube 415 may travel upwards towards the surface along the exterior of the downhole pump 300 to a tee 420, which may be located near the upper barrel 310. Another branch of the tee 420 may be connected to the upper side outlet 335, and the remaining branch of the tee 420 may be connected to a continuous length of the produced liquids tube 415, which may proceed to production facilities at the surface. The power control line 405 and the restroke control line 410 may also be positioned to the exterior of downhole pump 300.

Figure 3B:
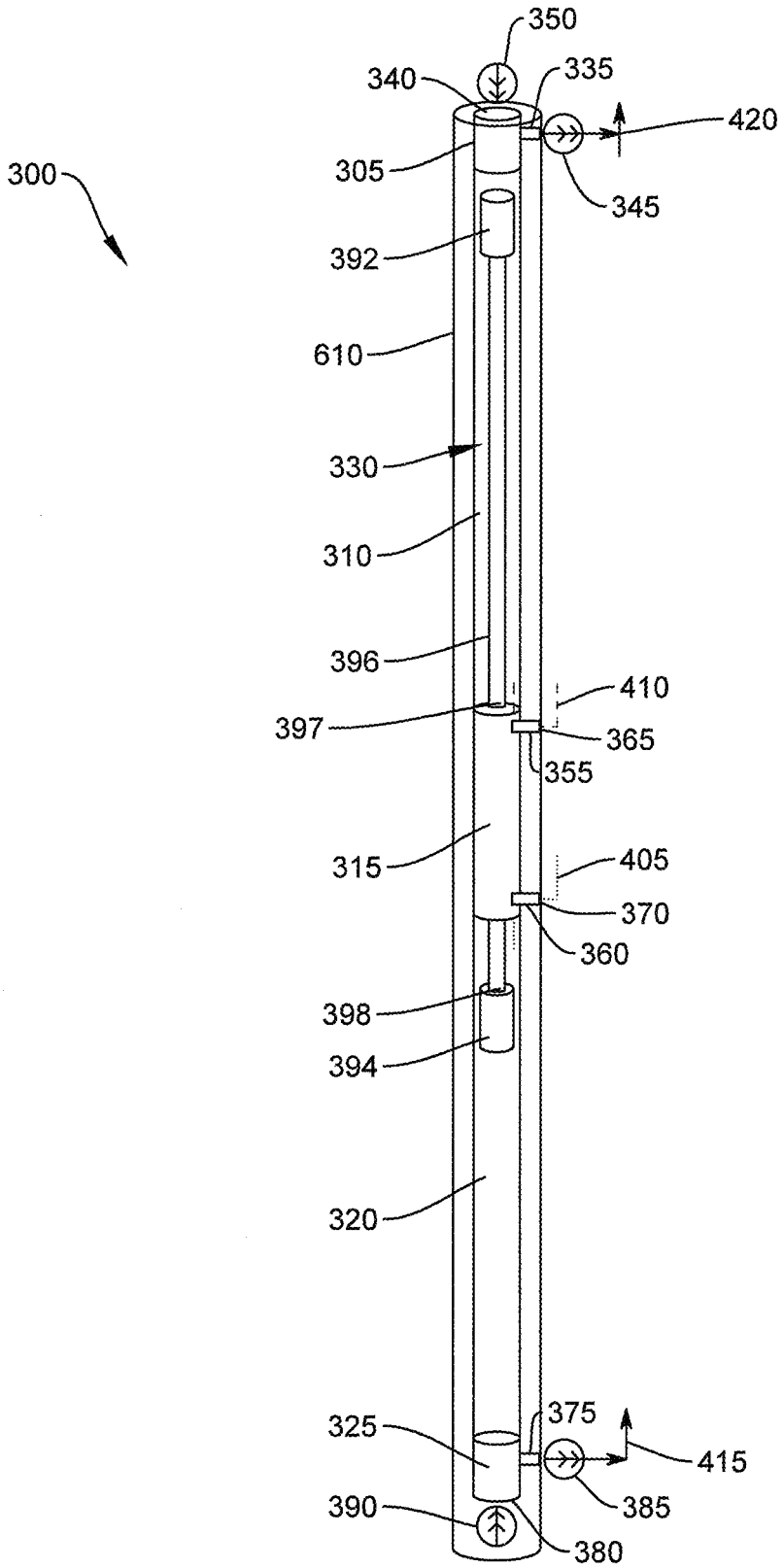
FIG. 3B is an illustration of an alternative embodiment of a double-acting downhole hydraulic reciprocating pump comprising grooves and sealing elements.

In embodiments, the power control line 405, the restroke control line 410, and the produced liquids tube 415 may each be long enough to reach the desired setting depth of the downhole pump 300. The setting depth may be near the depth of the production perforations within the wellbore 600. Further, the power control line 405, the restroke control line 410, and the produced liquids tube 415 may each be capable of being spooled and transported on a reel as explained in more detail below. The diameters of the power control line 405, the restroke control line 410, and the produced liquids tube 415 may each be sized such that pressure losses due to hydraulic friction while pumping do not significantly impede the desired production rates of produced liquids 605; each has sufficient mechanical strength to support its own weight full of liquid while hanging from the surface to the desired setting depth of the downhole pump 300; each has sufficient mechanical strength to transmit the fluids with the pressures necessary without bursting or collapsing while operating the downhole pump 300; and the external cross-sectional distance of the power control line 405, the restroke control line 410, and the produced liquids tube 415 held together in a triangular configuration may be sufficiently small to allow the power control line 405, the restroke control line 410, and the produced liquids tube 415 to fit inside a casing 610 in the wellbore 600, as shown in FIG. 3B. In embodiments, the casing 610 in the wellbore 600 may comprise an outside diameter of 3.5 inches or greater. Additionally, such embodiments may not require jointed tubing or rods as well as packer/external sealing elements. In fact, one of the advantages of such embodiments is the ability for the operator to work through kinks and doglegs in the wellbore 600 as well as around high build rates such as those in curved and/or horizontal wells, which may allow the downhole pump 300 at a lower depth downhole. Furthermore, the power control line 405, the restroke control line 410, and the produced liquids tube 415 may comprise stainless steel or other metallurgical compositions depending on the application. In embodiments, the diameter of the power control line 405, the restroke control line 410, and the produced liquids tube 415 may range from 0.375 to over 1.25 inches.

Figure 4A:
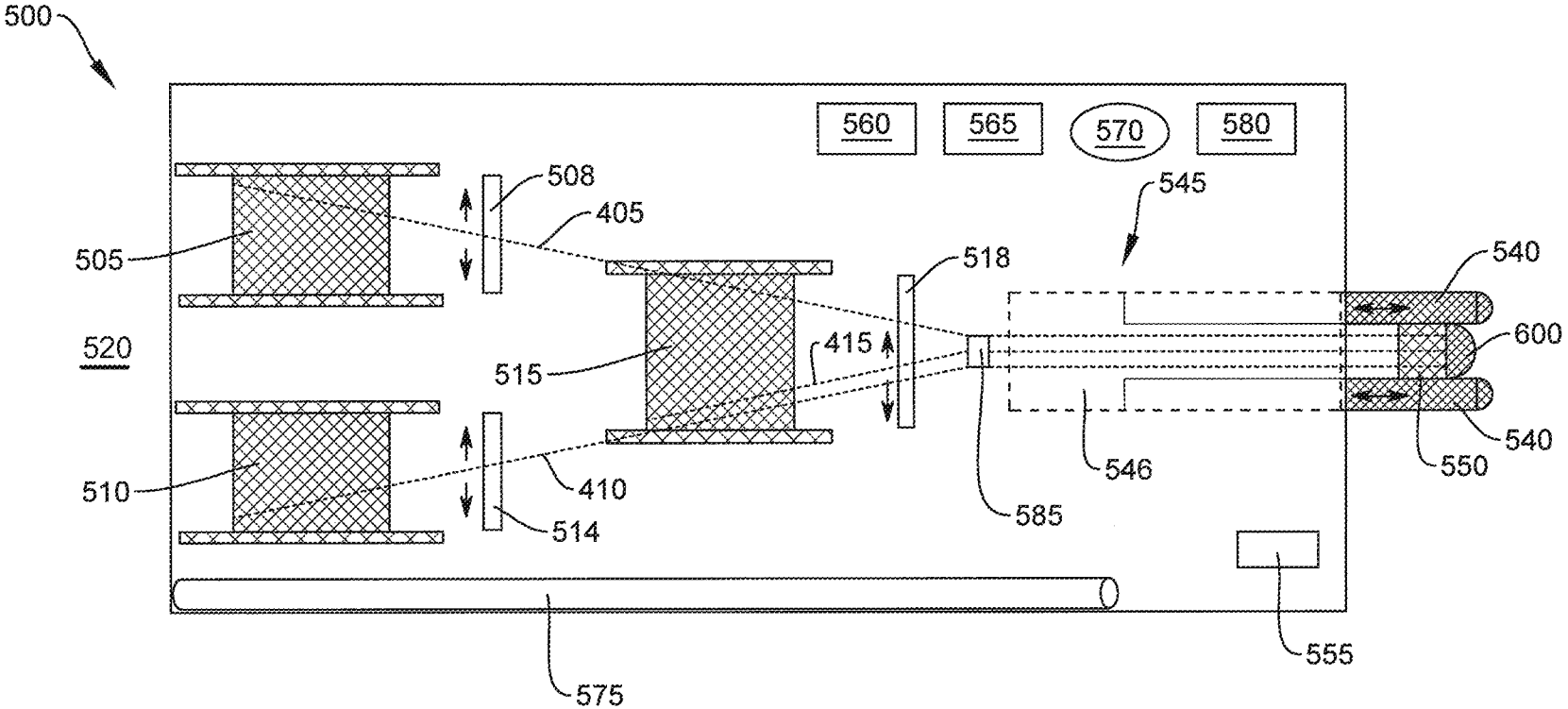
FIG. 4A is an illustration of an overhead view of an embodiment of a trailer.
Figure 4B:
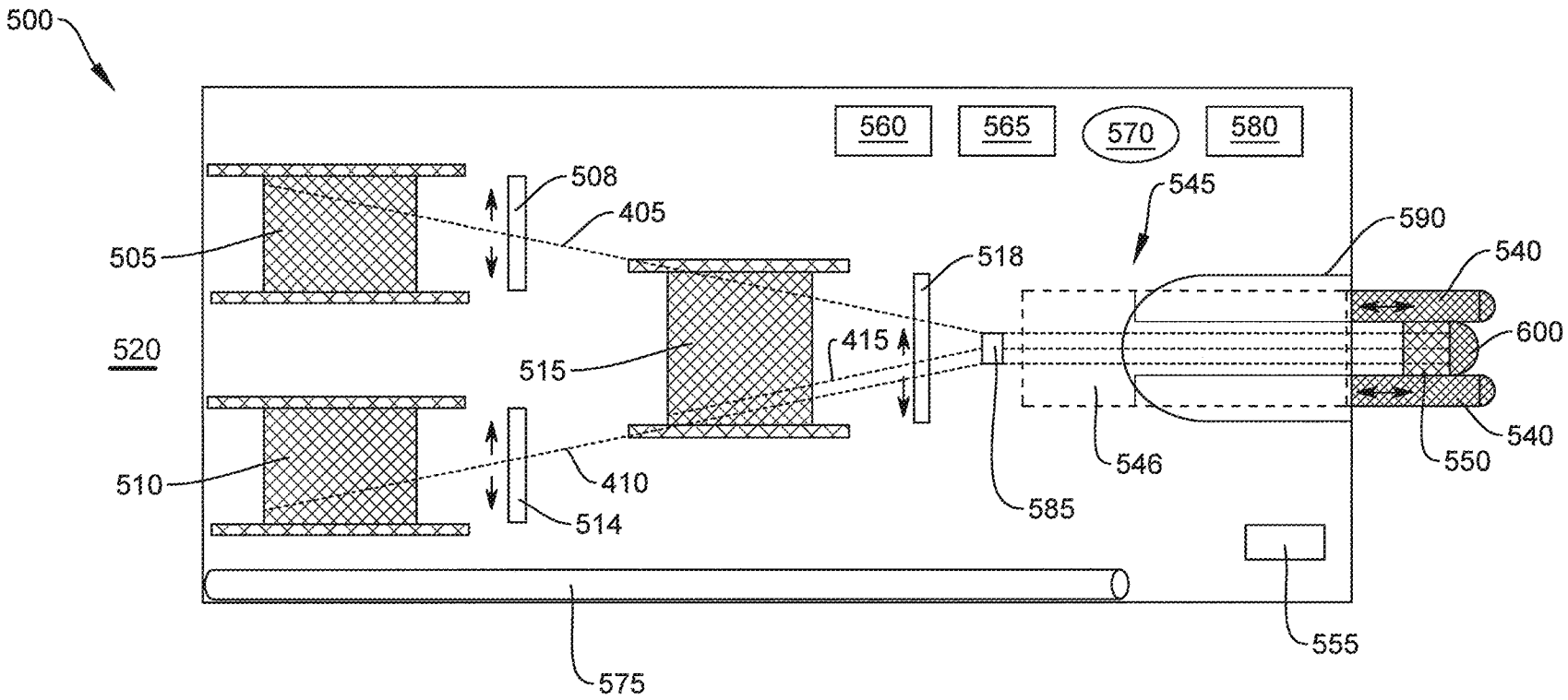
FIG. 4B is an illustration of an overhead view of an alternative embodiment of a trailer.
Figure 5:
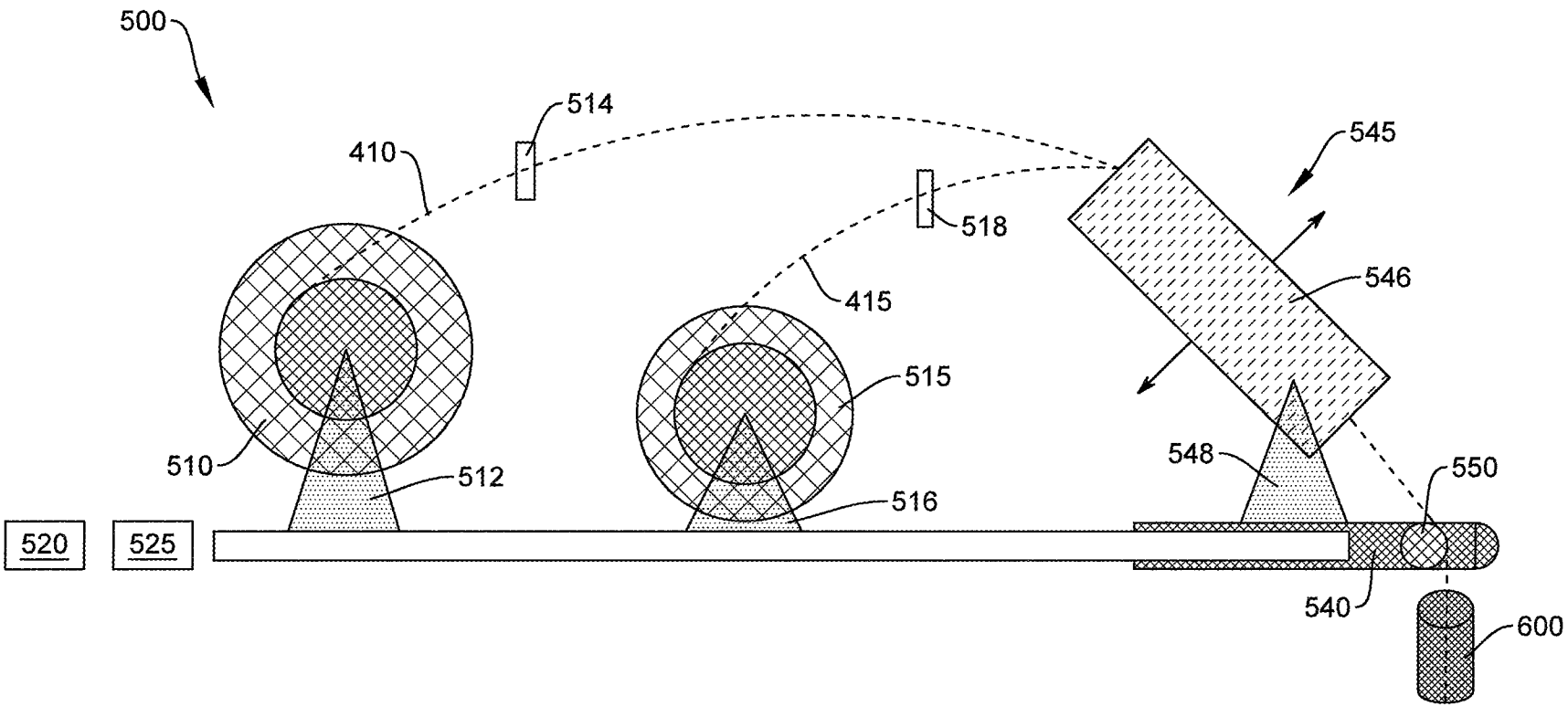
FIG. 5 is an illustration of a side view of an embodiment of a trailer.

FIGS. 4 and 5 illustrate an embodiment of the trailer 500. In embodiments, the trailer 500 comprise a first reel 505, a second reel 510, a third reel 515, a hitch 520, a power pack 525, a triplex pump/motor 530, an injector system 545, a crane 555, one or more outriggers 560, a power fluid storage tank 570, and a storage closet 580. In some embodiments, the trailer 500 may comprise one or more rails 540, one or more sheaves 550, a generator 565, and a tool storage apparatus 575. In embodiments, the trailer 500 may comprise a length of 30 feet and a width of 8.0 feet. In certain embodiments, the power fluid storage tank 570 may comprise a 100-gallon or larger tank.

In embodiments, the first reel 505 may comprise a first mount 506 and a first line level 508. The first reel 505 may have the power control line 405 spooled around it. In embodiments, the first reel 505 may be positioned next to the second reel 510 as shown in FIG. 4A. Further, the first reel 505 may be capable of spooling 5,000 to 10,000 feet of the power control line 405. The first reel 505 may be powered to respool individually or in sync with the second reel 510 and/or the third reel 515. The first line level 508 may be employed for an organized, efficient respooling of the power control line 405. In embodiments, the first reel 505 may be capable of accessing the ends of the power control line 405 upon the first spooling of the power control line 405. Thus, there may not be a need for a hydraulic swivel. Additionally, the first reel 505 may be powered and equipped with controls to give off the power control line 405 from the first reel 505 and retrieve the power control line 405 to the first reel 505 when deploying the downhole pump 300 or retrieving the downhole pump 300, respectively.

In embodiments, the second reel 510 may comprise a second mount 512 and a second line level 514. The second reel 510 may have the restroke control line 410 spooled around it. In embodiments, the second reel 510 may be positioned next to the first reel 505 as shown in FIG. 4A. Further, the second reel 510 may be capable of spooling 5,000 to 10,000 feet of the restroke control line 410. The second reel 510 may be powered to respool individually or in sync with the first reel 505 and/or the third reel 515. The second line level 514 may be employed for an organized, efficient respooling of the restroke control line 410. In embodiments, the second reel 510 may be capable of accessing the ends of the restroke control line 410 upon the first spooling of the restroke control line 410. Thus, there may not be a need for a hydraulic swivel. Additionally, the second reel 510 may be powered and equipped with controls to give off the restroke control line 410 from the second reel 510 and retrieve the restroke control line 410 to the second reel 510 when deploying the downhole pump 300 or retrieving the downhole pump 300, respectively.

In embodiments, the third reel 515 may comprise a third mount 516 and a third line level 518. The third reel 515 may have the produced liquids tube 415 spooled around it. In embodiments, the third reel 515 may be positioned closer to the mid-point of the length of the trailer 500 as shown in FIG. 4A. Further, the third reel 515 may be capable of spooling 5,000 to 10,000 feet of the produced liquids tube 415. The third reel 515 may be powered to respool individually or in sync with the second reel 510 and/or the first reel 505. The third line level 518 may be employed for an organized, efficient respooling of the produced liquids tube 415. In embodiments, the third reel 515 may be capable of accessing the ends of the produced liquids tube 415 upon the first spooling of the produced liquids tube 415. Thus, there may not be a need for a hydraulic swivel. Additionally, the third reel 515 may be powered and equipped with controls to give off the produced liquids tube 415 from the third reel 515 and retrieve the produced liquids tube 415 to the third reel 515 when deploying the downhole pump 300 or retrieving the downhole pump 300, respectively.

In other embodiments, the trailer 500 may comprise a different arrangement wherein the first reel 505, the second reel 510, and the third reel 515 may be positioned differently. For example, one such embodiment may comprise the first reel 505 closer to one end of the trailer 500 than the second reel 510, such that the first reel 505, the second reel 510, and the third reel 515 may be effectively in line.

In embodiments, the power pack 525 may be electric or hydraulic. The triplex pump/motor 530 may be employed to displace cap tubes at 0-4 gpm by 0-5,000 psi, and the triplex pump/motor 530 may be electric or hydraulic. Further, the triplex pump/motor 530 may comprise an inverter with variable speeds if it is electric.

In embodiments, the one or more rails 540 may be extended out the back of the trailer 500 as shown in FIG. 4A. The rails 540 may be employed to first assemble the downhole pump 300 over the wellbore 600 then to position the injector system 545 off the end of the trailer 500 and directly over the wellbore 600. During transport, the downhole pump 300 components may be secured on the trailer 500. In embodiments, once the downhole pump 300 is deployed, the trailer 500 may leave the worksite until the downhole pump 300 is to be retrieved. The rails 540 may comprise I-beams, and the rails 540 may provide a false rotary to hang off tools in the wellbore 600 for assembly. The rails 540 may be employed to align the power control line 405, the restroke control line 410, and the produced liquids tube 415 with the center of the wellbore 600 to prevent wear on the casing and the piping 400. In alternative embodiments, the trailer 500 may comprise a u-shaped slot 590 in the end of the trailer 500 opposite to the hitch 520 as shown in FIG. 4B. The u-shaped slot 590 may allow the trailer 500 to back over the wellbore 600 such that the u-shaped slot 590 may encircle the wellbore 600. Further, the u-shaped slot 590 may allow for an injector head 546 to be centered over the wellbore 600.

Figure 6:
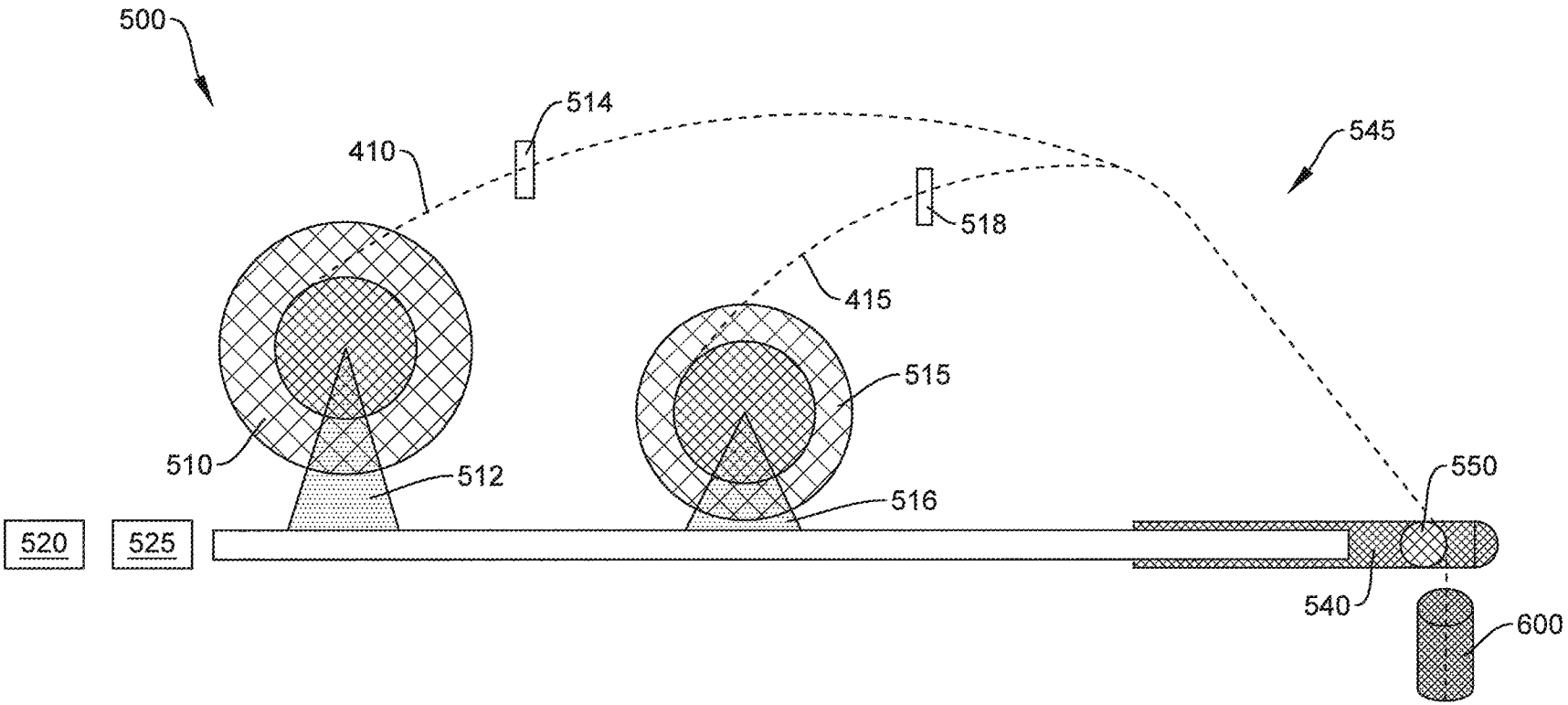
FIG. 6 is an illustration of a side view of an alternative embodiment of a trailer.

In embodiments, the injector system 545 may comprise the injector head 546, the injector mount 548, and a control line alignment assembly 585. The injector system 545 may be positioned 30-90 degrees from horizontal such that the injector system 545 may overhang the wellbore 600. The injector system 545 also includes a braking ability. The control line alignment assembly 585 may direct the power control line 405, the restroke control line 410, and the produced liquids tube 415 into and out of the injector head 546 in relation to the first reel 505, the second reel 510, and the third reel 515. Further, the injector system 545 may be capable of gripping all three tubes (the power control line 405, the restroke control line 410, and the produced liquids tube 415) at once while supporting the weight of each tube. Additionally, the injector system 545 may be capable of pushing all three tubes (the power control line 405, the restroke control line 410, and the produced liquids tube 415) simultaneously into the wellbore 600 or likewise pulling all three tubes (the power control line 405, the restroke control line 410, and the produced liquids tube 415) simultaneously out of the wellbore 600. The injector system 545 may work independently of or in sync with the first reel 505, the second reel 510, and/or the third reel 515. Further, in alternative embodiments, the trailer 500 may not comprise the injector head 546 or the injector mount 548 as shown in FIG. 6. In such alternative embodiments, the power from the reels 505, 510, 515 may be employed to spool and unspool the power control line 405, the restroke control line 410, and the produced liquids tube 415, respectively. Such alternative embodiments may be employed, for example in shallow wellbores 600 down to about 3,000 feet in depth.

In embodiments, the one or more sheaves 550 may direct the power control line 405, the restroke control line 410, and the produced liquids tube 415 into and out of the wellbore 600 in relation to the injector head 546. Further, the sheaves 550 may prevent the piping 400 from getting kinked.

In embodiments, the crane 555 may have the ability to handle items about 2,000 pounds. The crane 555 may be employed to maneuver small loads ground-to-ground, ground to trailer 500, and trailer 500 to ground. Further, the crane 555 may be mounted at or near the rear of the trailer 500.

In embodiments, the one or more outriggers 560 may be placed under the floor of the trailer 500, wherein the outriggers 560 may be extended out to the side of the trailer 500 when needed. In alternative embodiments, other stabilizers may be employed. Whether outriggers 560 or other stabilizers may be employed may depend on the loads to be carried by the crane 555, on the weight of the trailer 500, the maximum pull needed, and other factors.

In embodiments, the generator 565 may be a +/−10 KW generator. The generator 565 may be employed to power the trailer 500. The generator 565 may be mounted on a truck bed or mounted on the trailer 500 depending on use of the generator 565. The generator 565 may power the triplex pump/motor 530. Alternatively, the generator 565 may power the triplex pump/motor 530 and the trailer 500. Further, the generator 565 may be employed on the trailer 500 to deploy the piping 400 (the power control line 405, the restroke control line 410, and the produced liquids tube 415).

In embodiments, the power fluid storage tank 570 may be mounted on a truck bed, and the power fluid storage tank 570 may comprise a clear or opaque color. In embodiments, the tool storage apparatus 575 may comprise tubes with a diameter of between 4.0 to 6.0 inches, wherein the tubes may run along the length of the trailer 500. The apparatus 575 may be located on the underside of the trailer 500 and have a minimum length of 20 feet. Further, the apparatus may be made of PVC. Alternatively, the apparatus 575 may comprise piping cut in half to create a trough or iron shaped in Ls or Cs. In embodiments, the storage closet 580 may be employed to store tools, supplies, and other materials.

The following describes an embodiment of the reset or up-stroke of the downhole pump 300 as illustrated in FIGS. 1 and 3. In embodiments, the first three-way valve 260 may be actuated and aligned such that a flow path may be created between the PDP 215 and the restroke control line 410. Simultaneously, the second three-way valve 265 may be actuated and aligned such that a flow path may be created between the power control line 405 and the power fluid reservoir 205. In this state, the restroke control line 410 may be isolated from the power fluid reservoir 205 and the power control line 405 may be isolated from the PDP 215. Power fluid 255 may be then pumped down the restroke control line 410, wherein the upper plunger 392 and the lower plunger 394 may move toward the surface, within the upper barrel 310 and the lower barrel 320, respectively. As a result, the produced liquids 605 in the upper barrel 310 and above the upper plunger 392 may be compressed, wherein the produced liquids 605 may be forced to exit the upper ported intake sub 305 through the upper outlet check valve 345 and into the produced liquids tube 415. Simultaneously, power fluid 255 in the lower barrel 320 and above the lower plunger 394 may be compressed and returned to the power fluid reservoir 205 through the power control line 405. During the up-stroke, the portion of the lower barrel 320 below the lower plunger 394 may be filled with produced liquids 605 through the lower ported intake sub 325 and the lower intake check valve 390.

The following describes an embodiment of the power or down-stroke of the downhole pump 300 as illustrated in FIGS. 2 and 3. In embodiments, the first three-way valve 260 may be actuated and aligned such that a flow path may be created between the PDP 215 and the power control line 405. Simultaneously, the second three-way valve 265 may be actuated and aligned such that a flow path may be created between the restroke control line 410 and the power fluid reservoir 205. In this state, the power control line 405 may be isolated from the power fluid reservoir 205 and the restroke control line 410 may be isolated from the PDP 215. The power fluid 255 may be pumped down the power control line 405, wherein the upper plunger 392 and the lower plunger 394 may move downhole and away from the surface, within the upper barrel 310 and the lower barrel 320, respectively. As a result, the produced liquids 605 in the lower barrel 320 and below the lower plunger 394 may be compressed, wherein the produced liquids 605 may be forced to exit the lower ported intake sub 325 through the lower outlet check valve 385 and into the produced liquids tube 415. Simultaneously, power fluid 255 in the upper barrel 310 and below the upper plunger 392 may be compressed and returned to the power fluid reservoir 205 through the restroke control line 410. During the down-stroke, the portion of the upper barrel 310 above the upper plunger 392 may be filled with produced liquids 605 through the upper ported intake sub 305 and the upper intake check valve 350.

In operation, in embodiments the trailer 500 may be backed up to the wellbore 600. Further, the injector head 546 may be deployed directly above the wellbore 600. The trailer 500 may be employed to deploy and retrieve the piping 400 and the downhole pump 300, as well as transport other materials and supplies needed for operations as described above.

Additionally, in embodiments the system 100 may be employed with old, depleted, or more broadly modest daily liquid volume wells. One of the benefits of the embodiments disclosed herein is that the system 100 only employs 12% of the steel needed for rod pump systems. Additionally, the system 100 may be comprised of stainless steel to avoid corrosion. Also, the system 100 comprises fewer moving parts compared to other systems. Furthermore, system 100 may require a smaller footprint, less maintenance, reduced infrastructure needs, and thus allow for much quicker deployments in addition to redeployments relative to existing art.

The invention claimed is:

1. A method of pumping produced liquids in a downhole wellbore during a reset stroke of a pump, comprising:

providing surface equipment comprising:

a first three-way valve;

a positive displacement pump (PDP);

a second three-way valve; and a power fluid reservoir, wherein the power fluid reservoir contains power fluid;

providing a downhole pump comprising:

an upper barrel;

a lower barrel;

an upper plunger, wherein the upper plunger is positioned within the upper barrel;

a lower plunger, wherein the lower plunger is positioned within the lower barrel;

an upper ported intake sub, wherein the upper ported intake sub comprises an upper outlet check valve and an upper intake check valve;

a dual ported mandrel; and a lower ported intake sub, wherein the lower ported intake sub comprises a lower intake check valve and a lower outlet check valve;

providing a restroke control line, a power control line, and a produced liquids tube;

actuating and aligning the first three-way valve, wherein a first flow path is created between the PDP and the restroke control line;

actuating and aligning the second three-way valve, wherein a second flow path is created between the power control line and the power fluid reservoir; and pumping the power fluid into the restroke control line, wherein the upper plunger is forced to move toward the surface within the upper barrel, wherein produced liquids in the upper barrel between the upper plunger and the upper ported intake sub are compressed and forced to exit the upper ported intake sub through the upper outlet check valve and into the produced liquids tube, and further wherein the lower plunger is forced to move toward the surface within the lower barrel, wherein power fluid in the lower barrel between the lower plunger and the dual ported mandrel is compressed and returned to the power fluid reservoir through the power control line;

wherein during the step of pumping power fluid into the restroke power line, the portion of the lower barrel between the lower plunger and the lower ported intake sub is filled with produced liquids through the lower intake check valve.

2. The method of claim 1, wherein the steps of actuating and aligning the first three-way valve and the second three-way valve occur simultaneously.

3. The method of claim 1 further comprising the pumping of produced liquids in the downhole wellbore during a power stroke of the pump, comprising:

actuating and aligning the first three-way valve, wherein a third flow path is created between the PDP and the power control line;

actuating and aligning the second three-way valve, wherein a fourth flow path is created between the restroke control line and the power fluid reservoir; and pumping the power fluid into the power control line, wherein the upper plunger is forced to move downhole within the upper barrel, wherein the power fluid in the upper barrel between the upper plunger and the dual ported mandrel is compressed and returned to the power fluid reservoir through the restroke control line, and further wherein the lower plunger is forced to move downhole within the lower barrel, wherein the produced liquids in the lower barrel between the lower plunger and the lower ported intake sub are compressed and forced to exit the lower outlet check valve into the produced liquids tube;

wherein during the step of pumping the power fluid into the power control line, the portion of the upper barrel between the upper plunger and the upper ported intake sub is filled with produced liquids through the upper intake check valve.

4. The method of claim 3, wherein the steps of actuating and aligning the first three-way valve and the second three-way valve occur simultaneously.

* * * * *